US005314359A

United States Patent [19]

Probst

[11] Patent Number: 5,314,359

[45] Date of Patent: May 24, 1994

[54] BATTERY CABLE TERMINAL

[76] Inventor: Evan Probst, 1744 W. 2400 South, Charleston, Utah 84082

[21] Appl. No.: 73,339

[22] Filed: Jun. 7, 1993

[51] Int. Cl.[5] ..... H01R 4/26

[52] U.S. Cl. ..... 439/766; 439/762; 439/431

[58] Field of Search ..... 439/766, 431, 761-765, 439/757, 758

[56] References Cited

U.S. PATENT DOCUMENTS

| | | | |
|---|---|---|---|
| 1,507,936 | 9/1924 | Schmitt | 439/762 |
| 1,629,783 | 5/1927 | Finkle | 439/757 |
| 2,034,843 | 3/1936 | VonHagel | 307/326 |
| 3,048,646 | 8/1962 | England | 439/388 |

FOREIGN PATENT DOCUMENTS

| | | | |
|---|---|---|---|
| 497500 | 11/1953 | Canada | 439/757 |
| 690549 | 9/1930 | France | 439/757 |
| 418042 | 10/1934 | United Kingdom | 439/766 |
| 1288001 | 9/1972 | United Kingdom | 439/766 |

*Primary Examiner*—Gary F. Paumen
*Attorney, Agent, or Firm*—Mallinckrodt & Mallinckrodt

[57] ABSTRACT

A battery cable terminal for electrical connection with a terminal post of an electrical storage battery has an internally threaded, apertured platform electrically attached to and overlying a ring of preferably usual clamping formation so that a screw received by the aperture can be turned to bear against the exposed face of a battery terminal to which the ring is attached. The screw is provided with a cutting face at its terminal end for cutting into the exposed face of the battery terminal and making fresh electrical contact surface when turned to re-establish electrical contact between cable terminal and battery terminal.

7 Claims, 1 Drawing Sheet

BATTERY CABLE TERMINAL

BACKGROUND OF THE INVENTION

1. Field

The invention is in the field of connector terminals for electrical storage battery cables.

2. State of the Art

As ordinarily constructed, a connector terminal at the battery connecting end of a cable for electrical connection with a terminal post of a storage battery in an automotive vehicle, or in other equipment utilizing an electrical storage battery as a source of power, is a split ring for clamping onto the post of the storage battery. As corrosion takes place over a period of use, the electrical connection is impaired and often results in power failure, requiring removal of the split ring terminal from the battery post for cleaning before being reinstalled.

To avoid the time and work required to re-establish power transmission from the battery, various expedients have been proposed heretofore. Thus, Von Hagel U.S. Pat. No. 2,034,843 of Mar. 24, 1936 provides an auxiliary electrical conductor extending from electrical connection with the split ring and having at its end an electrically conductive spike for driving into the exposed face of the battery terminal post after installation of the split ring on such post, while a later U.S. Pat. No. 3,048,646 issued on Aug. 7, 1962 to a Canadian, H. O. England, provides a thumb screw at the end of an auxiliary electrical conductor for somewhat similarly re-establishing power transmission by a turn of such screw to force it between the terminal connector ring and the battery post for bringing such ring into tighter electrical contact with the battery post.

SUMMARY OF THE INVENTION

A principal purpose in the making of the present invention was to provide a relatively simple, convenient, and effective way to positively re-establish electrical connection between a terminal connector ring of a battery cable and a post of the battery following a break in electrical transmission due to corrosion or otherwise.

In the accomplishment of this objective, a feature of the invention is the use of the exposed face of the battery post to reestablish electrical connection at any time that may be required, by turning a screw that overlies the open interior of a terminal ring and bears against such exposed face as part of auxiliary electrical conductor means but provided with a cutting end that establishes a fresh mating surface for the post as the screw is turned.

THE DRAWINGS

The best way presently contemplated for carrying out the invention in commercial practice is illustrated in the accompanying drawing, in which:

FIG. 1 represents a pictorial view of a presently preferred embodiment of the invention installed on a post of a storage battery that is shown only fragmentarily;

FIG. 2, a vertical section taken along the line 2—2 of FIG. 1; and

FIG. 3, a horizontal section taken along the line 3—3 of FIG. 1.

DETAILED DESCRIPTION OF THE ILLUSTRATED EMBODIMENT

Figure 1:
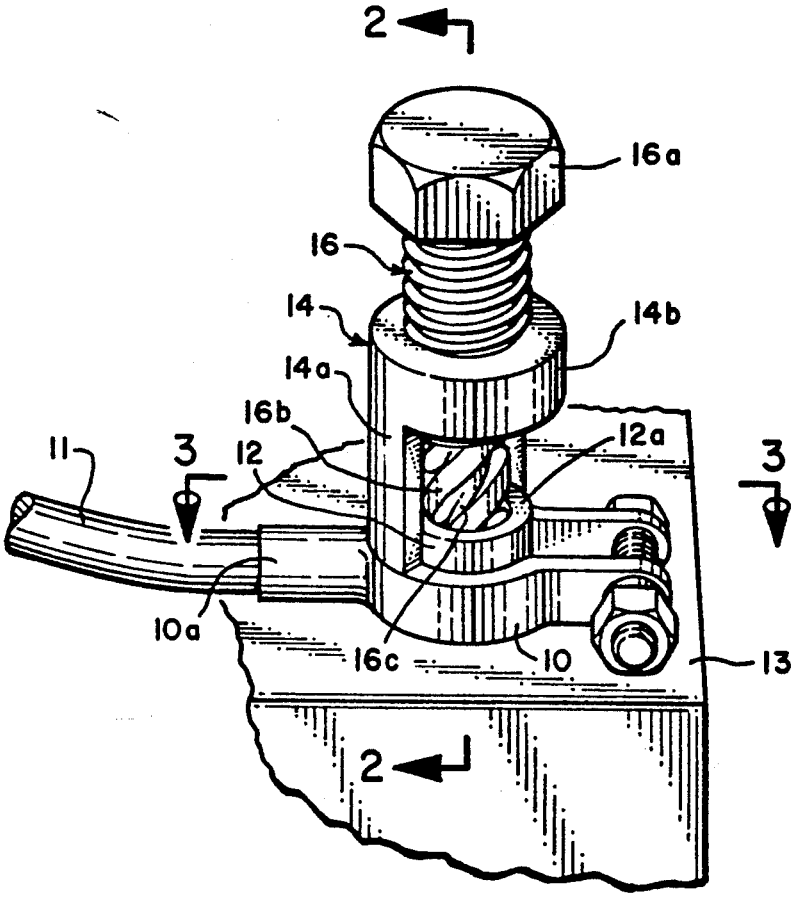
Figure 2:
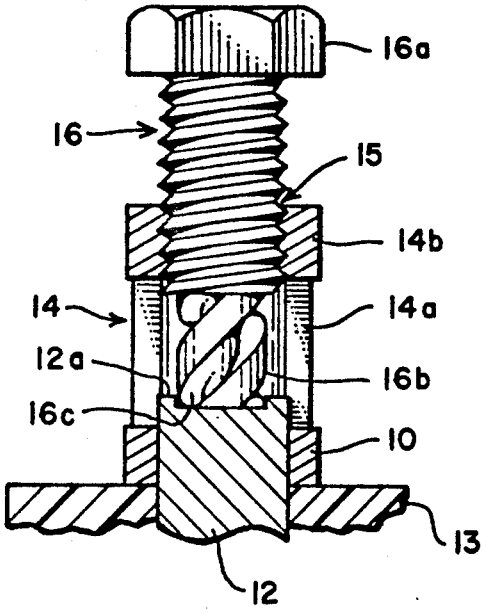
Figure 3:
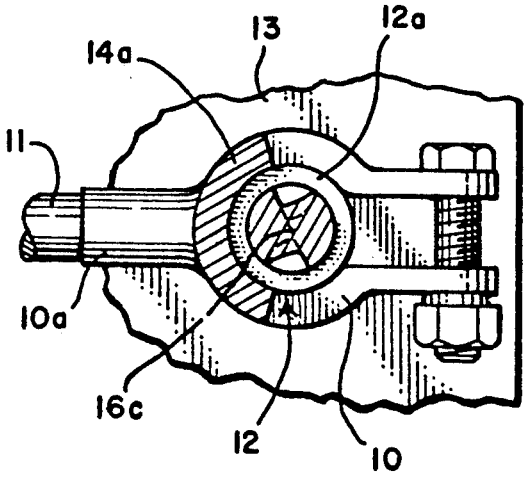

In the form illustrated, an electrical terminal ring 10 of usual split ring, clamping type is fastened to the battery connection end of a usual battery cable 11 for connection in customary manner to a terminal post 12 of an electrical storage battery 13.

The terminal ring 10 constitutes part of the novel battery cable terminal of the invention. Affixed thereto, as by welding or by being formed integrally therewith, and rising rigidly therefrom, is the leg member **14*a* of a bracket 14 which has an apertured platform member 14*b* (which may be of nut formation if desired) extending transversely therefrom so that the aperture 15 thereof overlies the open interior of the terminal ring 10**.

Leg member **14*a* is preferably transversely arcuate in conformity with the curvature of ring 10 so as to firmly support platform member 14*b* in position over terminal ring 10**.

Aperture 15 is internally threaded to receive a screw member 16, here shown in the form of a bolt having a hexagonal head **16*a* serving as a means to be engaged by a wrench for turning the screw 16 toward and away from the flat exposed end face 12*a* of battery terminal post 12** when the battery cable terminal is installed on such post.

Terminal ring 10, as usual, is provided with means, here in the form of a tubular extension **10*a* formed integrally therewith, for receiving and electrically connecting such ring with the electrical conductor in battery cable 11**.

In accordance with the invention, an end **16*b* of screw member 16, that confronts the exposed face 12*a* of battery terminal post 12 when the battery cable terminal is installed on such post, is formed with a cutting face 16*c* that is adapted to bear against such exposed face 12*a* as the screw is turned in the proper direction and that cuts into such exposed face to expose fresh surface for close electrical contact with screw member 16** as turning of the screw continues.

As shown, cutting face **16*c* of screw member 16 is advantageously formed as the cutting face of a drill so as to cut off a thin layer of metal superficially of battery terminal post 12 as needed to re-establish tight electrical contact that has been interrupted by corrosion or surface deterioration over a period of time. However, cutting face 16*c* may be otherwise formed for cutting into exposed face 12*a* of the battery terminal post, for example by having abrasive particles secured thereto. Moreover, instead of a bolt head providing means for turning screw member 16**, a usual screw-driver-receiving slot, a thumb screw formation, or other arrangement may provide such means.

As illustrated, the terminal end face **16*c* of screw 16 that bears against the exposed face 12*a* of battery terminal post 12 is preferably substantially flat and of area that covers most of the exposed face 12*a* of such terminal post 12**.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A battery cable terminal for establishing electrical connection with a terminal post of an electrical storage battery, comprising an electrically conductive terminal ring having means for electrical connection with a battery cable; an electrically conductive bracket electrically conductively associated with said terminal ring and providing a transverse platform member with an internally threaded aperture overlying the open interior portion of said terminal ring; and an electrically conductive screw member threadedly received by said aperture of the platform member of the bracket and having an end face adapted to bear against the exposed face of a terminal post of an electrical storage battery when said terminal ring is installed thereon and as said screw member is screwed toward said terminal ring, said end face of the screw member being provided with means for cutting into said exposed face of the terminal post when said screw is turned as it bears against said face, and said screw having means whereby it may be turned.

2. A battery cable terminal in accordance with claim 1, wherein said end face of the screw member is of drill formation as the means for cutting into the exposed face of the terminal post.

3. A battery cable terminal in accordance with claim 1, wherein the screw member is of bolt formation having a head end for engagement by a wrench.

4. A battery cable terminal in accordance with claim 1, wherein the screw member has a head end provided with the means for turning said screw member.

5. A battery cable terminal in accordance with claim 1, wherein the bracket comprises a leg member electrically conductively affixed to the terminal ring, and the platform member extends transversely from said leg member.

6. A battery cable terminal in accordance with claim 5, wherein the leg member is of arcuate formation transversely of its length and curved in substantial conformity with the curvature of the terminal ring.

7. A battery cable terminal in accordance with claim 1, wherein the end of the screw that bears against the exposed face of the battery terminal post is substantially flat and covers most of said exposed face of said terminal post.

* * * * *